US009657541B2

(12) United States Patent
Schultz et al.

(10) Patent No.: US 9,657,541 B2
(45) **Date of Patent: *May 23, 2017**

(54) METHOD OF USING A DOWNHOLE TOOL WITH EROSION RESISTANT LAYER

(71) Applicant: Thru Tubing Solutions, Inc., Oklahoma City, OK (US)

(72) Inventors: Roger Schultz, Newcastle, OK (US); Brock Watson, Oklahoma City, OK (US)

(73) Assignee: thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/050,674

(22) Filed: Oct. 10, 2013

(65) Prior Publication Data

US 2014/0216747 A1 Aug. 7, 2014

Related U.S. Application Data

(63) Continuation of application No. 13/971,411, filed on Aug. 20, 2013, now abandoned.

(60) Provisional application No. 61/759,746, filed on Feb. 1, 2013.

(51) Int. Cl.

| | |
|---|---|
| ***E21B 43/114*** | (2006.01) |
| ***E21B 23/00*** | (2006.01) |
| ***E21B 41/00*** | (2006.01) |
| ***E21B 28/00*** | (2006.01) |
| ***E21B 33/12*** | (2006.01) |
| ***E21B 43/26*** | (2006.01) |
| ***E21B 17/10*** | (2006.01) |

(52) U.S. Cl.

CPC ..... *E21B 23/00* (2013.01); *E21B 17/1085* (2013.01); *E21B 28/00* (2013.01); *E21B 33/12* (2013.01); *E21B 41/00* (2013.01); *E21B 43/114* (2013.01); *E21B 43/26* (2013.01)

(58) Field of Classification Search

CPC . E21B 17/1085; E21B 43/114; E21B 41/0078
USPC ..... 166/298, 55, 297; 51/295; 138/146
See application file for complete search history.

(56) References Cited

U.S. PATENT DOCUMENTS

| | | | | |
|---|---|---|---|---|
| 3,070,166 | A * | 12/1962 | Knauth | 166/255.3 |
| 3,075,582 | A * | 1/1963 | Morse et al. | 166/255.2 |
| 3,130,786 | A * | 4/1964 | Brown et al. | 175/424 |
| 3,795,275 | A * | 3/1974 | Bohn | 166/85.1 |
| 5,455,068 | A * | 10/1995 | Aves et al. | 427/237 |
| 5,829,539 | A * | 11/1998 | Newton et al. | 175/393 |
| 6,520,255 | B2 | 2/2003 | Tolman et al. | |
| 6,957,701 | B2 | 10/2005 | Tolman et al. | |
| 7,059,407 | B2 | 6/2006 | Tolman et al. | |
| 7,832,481 | B2 * | 11/2010 | Martindale | 166/298 |
| 2009/0152013 | A1 * | 6/2009 | Buske et al. | 175/340 |
| 2010/0206553 | A1 * | 8/2010 | Bailey et al. | 166/244.1 |
| 2010/0270086 | A1 * | 10/2010 | Matthews et al. | 175/425 |
| 2011/0079386 | A1 * | 4/2011 | Fripp et al. | 166/249 |

(Continued)

*Primary Examiner* — Catherine Loikith
(74) *Attorney, Agent, or Firm* — Hall Estill Law Firm

(57) ABSTRACT

This disclosure is related to downhole tool having an erosion resistant material metalurgically bonded to portions of the downhole tool. The downhole tool can have the erosion resistant material can be disposed on predetermined portions of inner and outer surfaces of the downhole tool. The disclosure is also related to a method of using the downhole tool described herein.

21 Claims, 10 Drawing Sheets

(56) References Cited

U.S. PATENT DOCUMENTS

| | | | | |
|---|---|---|---|---|
| 2011/0146989 | A1* | 6/2011 | Dotson | 166/298 |
| 2012/0193148 | A1* | 8/2012 | Overstreet et al. | 175/320 |

* cited by examiner

METHOD OF USING A DOWNHOLE TOOL WITH EROSION RESISTANT LAYER

CROSS-REFERENCE TO RELATED APPLICATIONS

The present application is a continuation of U.S. application Ser. No. 13/971,411, filed Aug. 20, 2013, which is a conversion of U.S. Provisional Application having U.S. Ser. No. 61/759,746, filed Feb. 1, 2013, which claims the benefit under 35 U.S.C. 119(e), the disclosures of which are hereby expressly incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to a downhole oil and gas tool having an erosion resistant layer disposed thereon.

2. Description of the Related Art

In standard abrasive perforating operations a hard material such as sand is typically used as an abrasive media which is mixed into a liquid slurry and pumped through a workstring from the surface to a downhole nozzle which creates a high-velocity jet. The high-velocity jet accelerates the particles in the slurry so that when they impact a target (such as casing or formation) erosion is created at the impingement surface. This is often used to create perforation tunnels through casing and out into the formation to allow fluid to pumped into the formation (such as fracking), or to allow hydrocarbon production from the reservoir into the casing.

In typical casing perforating operations, the abrasive material is pumped through the tubing exiting downhole through a jet and into the annulus between the supply tubular and the casing or other outer tubular. The high-velocity jet impinges on the casing ID and erodes a hole in the casing. A portion of the abrasive slurry from the jet is deflected at various angles back toward the perforator tool. This deflected fluid often causes significant erosion on the surface of the perforator tool. This erosion can severely damage the perforator tool causing the need for replacement or even failure of the perforator tool.

During formation fracturing operations the fluid flowing back from the formation into the wellbore typically carries some of the proppant (such as sand, ceramic particles, etc.) which was pumped into the formation during fracturing of the zone. Nearly all typically used types of proppants are abrasive in nature. When fluid flows back out of the formation during equalization of the formation after pressure is reduced after fracturing, the proppant often impacts the perforating tool with high velocity causing erosive damage. This damage can be very severe sometimes even cutting the perforator tool in half.

Accordingly, there is a need for a perforator that can withstand erosion during perforating and fracking operations.

SUMMARY OF THE INVENTION

The present disclosure is directed to a downhole tool having an erosion resistant material that is metalurgically bonded to the downhole tool. The present disclosure is also directed to a method for providing the downhole tool and metalurgically bonding an erosion resistant material to the downhole tool.

DETAILED DESCRIPTION OF THE INVENTION

Figure 1:
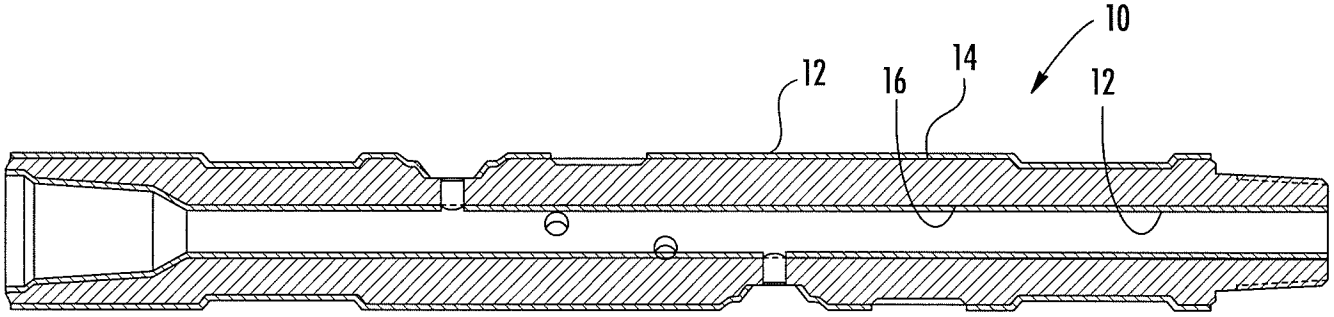
FIG. 1 is a cross-sectional view of a perforator tool constructed in accordance with the present disclosure.
Figure 2:
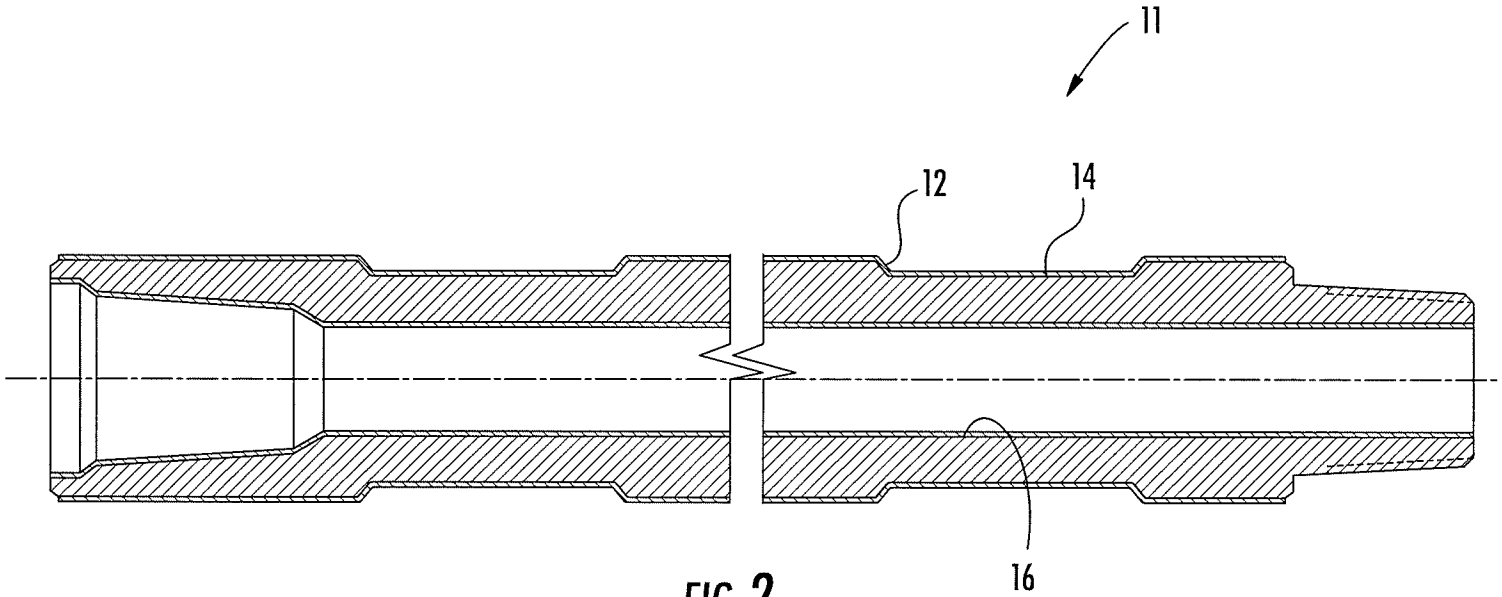
FIG. 2 is a cross-sectional view of another downhole tool constructed in accordance with the present disclosure.

The present disclosure, as shown in FIG. 1, relates to a perforator tool 10 with an erosion resistant material 12 disposed thereon. The present disclosure also relates to a method of using the perforator tool 10. The erosion resistant material 12 can be metalurgically bonded thereon to mitigate the effect of erosion experienced in oil and gas operations. Examples of erosion experienced during oil and gas operations include perforation "splash-back" and formation fracturing "flow-back" damage. The disclosure also relates to a method of manufacturing the perforator tool 10. It should be understood and appreciated that the erosion resistant material 12 can be metalurgically bonded to any downhole tool that is subject to erosion or is used in operations where the tool may be subject to perforation "splash-back" and/or "flow-back" during formation fracturing operations. FIG. 2 provides an example of another downhole tool, such as a blast joint 11, that can have the erosion resistant material 12 metalurgically bonded thereon. In another embodiment of the present disclosure, the perforator tool 10 can be used in conjunction with a packer 13. The packer 13 can be any type of packer known by one of ordinary skill in the art.

A metallurgical bond between two materials causes a sharing of electrons at an interface of the two materials, which produces a bond on the atomic level. No intermediate layers such as adhesives or braze metal are involved, nor are any fastening devices used to hold the erosion resistant material in place, such as pins, screws or the like. Erosion resistant materials 12 are typically very hard materials and can be metalurgically bonded to the perforator tool 10 via any method known to one of ordinary skill in the art. Examples of methods or processes used to metalurgically bond materials together include, but are not limited to, Laser Cladding and Plasma Transferred Arc (PTA).

The erosion resistant material 12 can be any material known in the art capable of withstanding erosion conditions experienced by downhole tools in oil and gas operations. In one embodiment, the erosion resistant material 12 contains tungsten carbide. The erosion resistant material 12 can also contain a matrix material to facilitate the metallurgical bond. Examples of matrix materials include, but are not limited to, nickel, cobalt, chromium, tungsten, molybdenum, silicon, iron, carbon, boron, aluminum, or a combination thereof.

FIG. 1 shows the perforator tool 10 which includes an outer surface 14 and an inner surface 16. In one embodiment, a layer of erosion resistant material 12 is metalurgically bonded to substantially all of the outer surface 14 of the perforator tool 10. In another embodiment, the perforator tool 10 can include a layer of erosion resistant material 12 metalurgically bonded to the inner surface 16 of the perforator tool 10 to mitigate internal erosion of the perforator tool 10. The erosion resistant material 12 can be provided on the perforator tool 10 in any amounts so that a predetermined depth (or thickness) of the erosion resistant material 12 is provided. The predetermined depth of the erosion resistant material 12 can be in a range of from about 0.005 inches to about 0.25 inches. In another embodiment, the predetermined depth of the erosion resistant material 12 can be in a range of from about 0.08 inches to about 0.16 inches. In yet another embodiment, the predetermined depth of the erosion resistant material 12 can be about 0.12 inches. It should be understood and appreciated that the depth of the erosion resistant material 12 on the perforator tool 10 can vary depending on where on the perforator tool 10 the erosion resistant material 12 is disposed. In these embodiments, the coverage and depth of the erosion resistant material 12 on the perforator tool 10 is only limited by the specific functionality of the tool. For example, the perforator tool 10 still has to be able to connect to other tools in a tool string, fluid still has to flow through the perforator, fluid still has to be able to flow out of perforator nozzles if the perforator tool 10 is equipped with nozzles, etc.

In yet another embodiment of the present disclosure, the erosion resistant material 12 is only disposed on predetermined areas of the perforator tool 10 where the tool 10 is more likely to be exposed to erosion. For example, the predetermined areas could be disposed around a nozzle (when perforating with nozzles) or in areas where tools experience a lot of flow back from fracturing operations.

Figure 3:
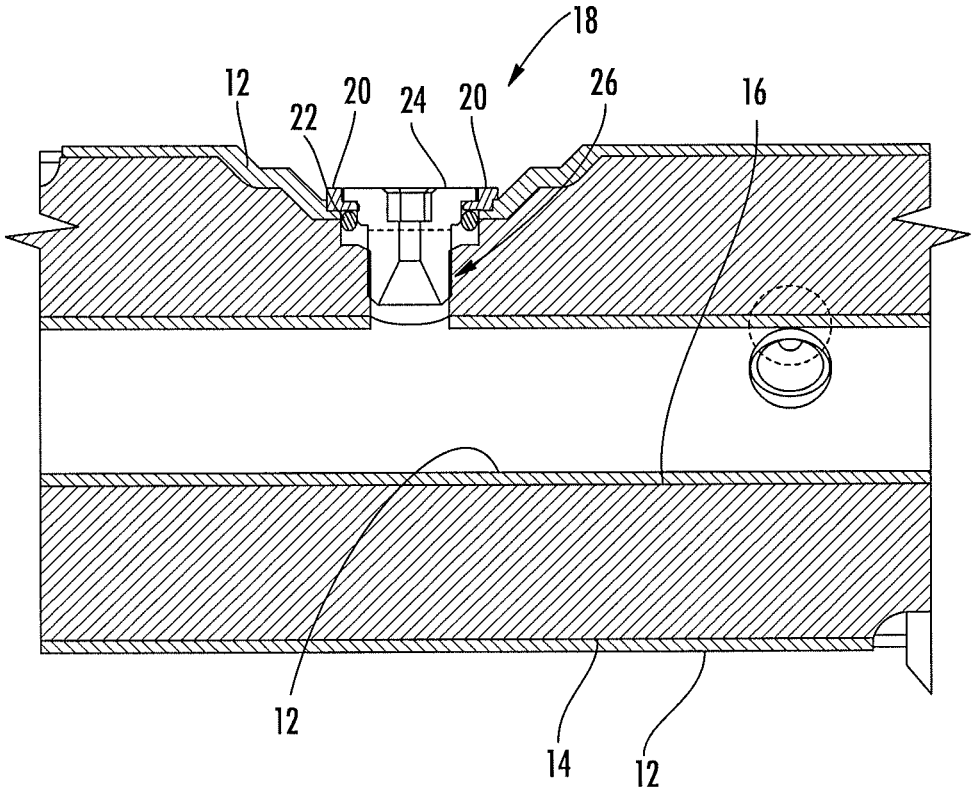
FIG. 3 is a cross-sectional view of one embodiment of a portion of the perforator tool constructed in accordance with the present disclosure.
Figure 4:
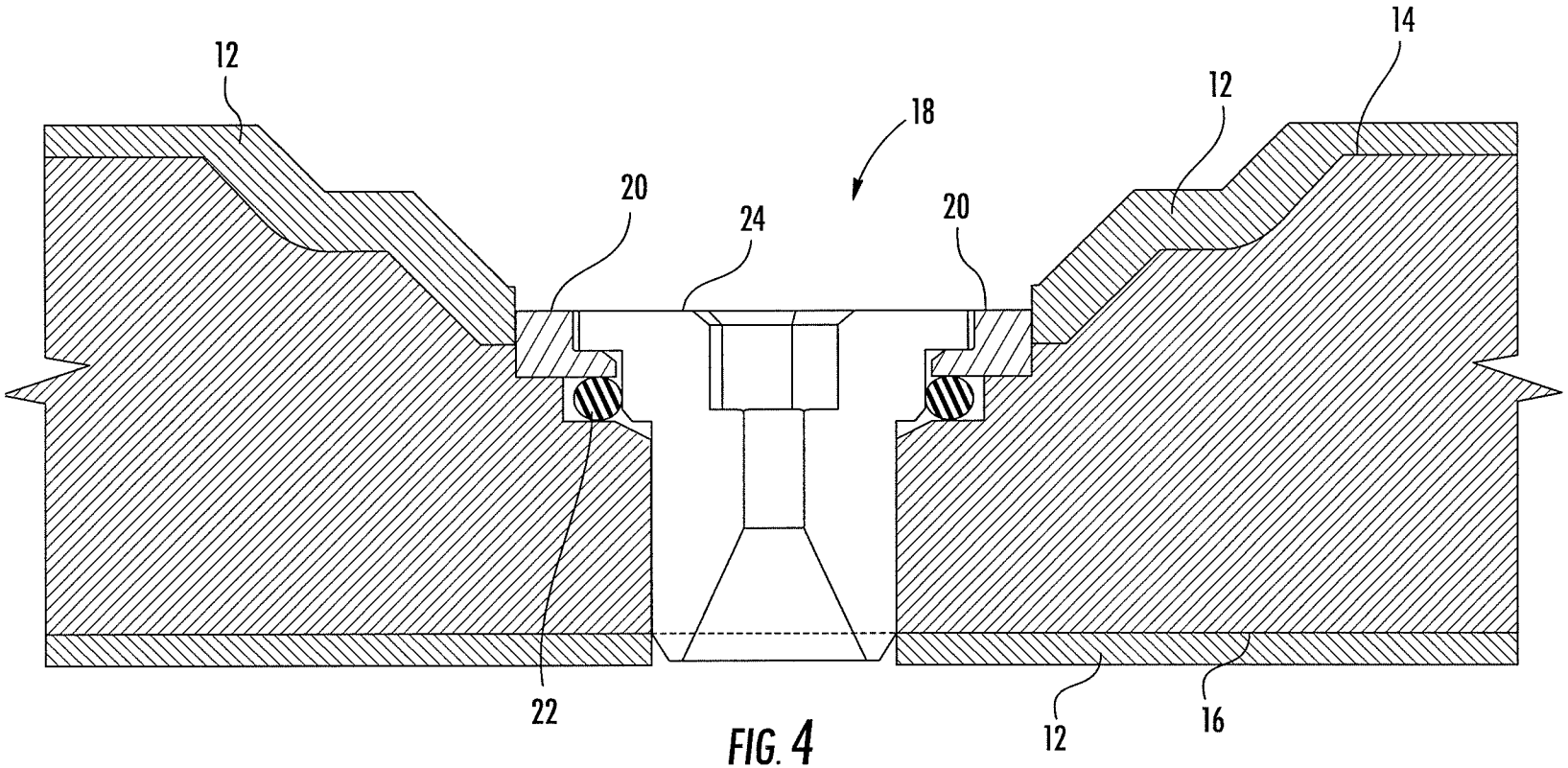
FIG. 4 is a cross-sectional view of another embodiment of a portion of the perforator tool constructed in accordance with the present disclosure.
Figure 5:
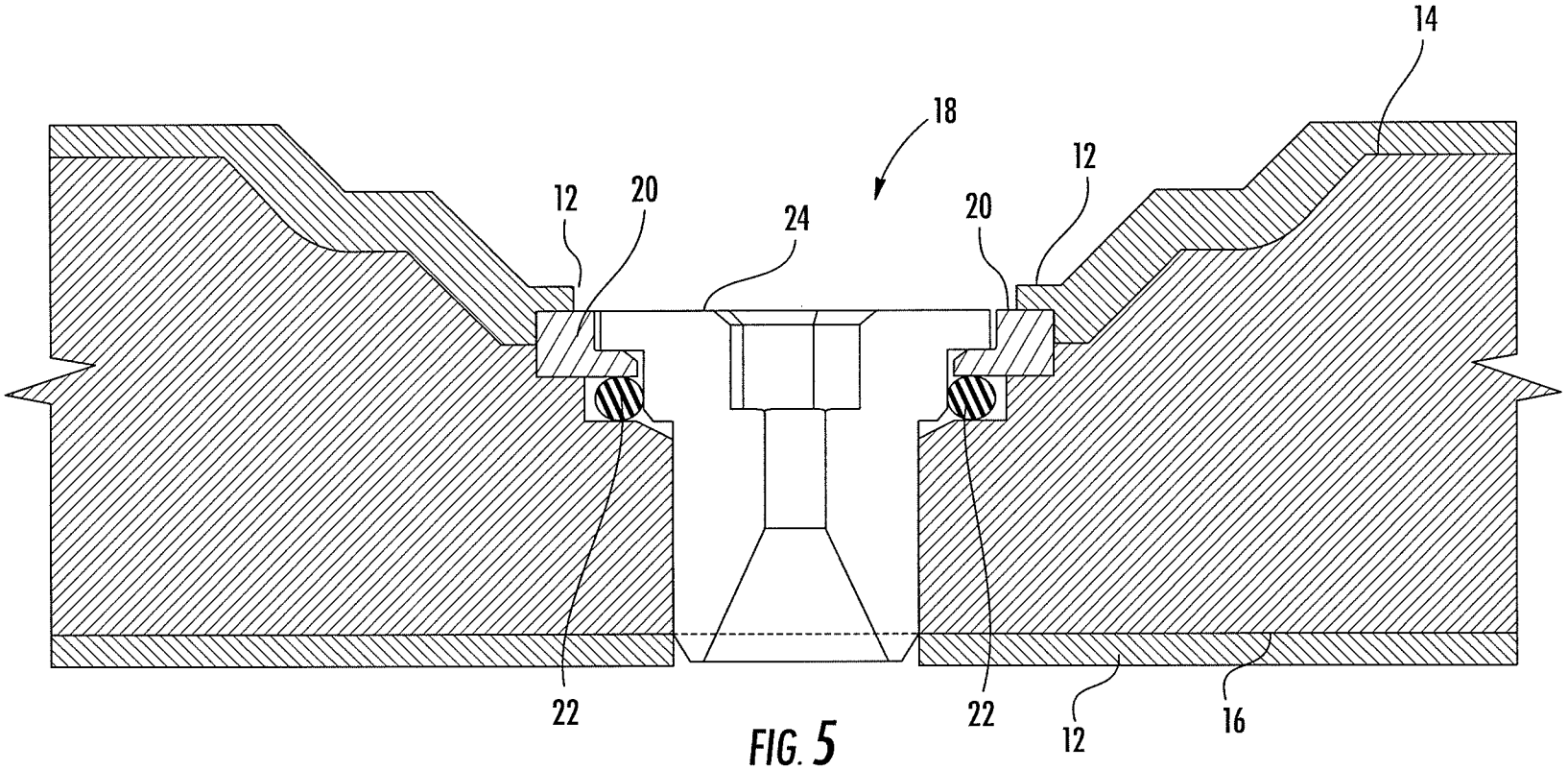
FIG. 5 is a cross-sectional view of yet another embodiment of a portion of the perforator tool constructed in accordance with the present disclosure.

As described herein, the perforator tool 10 can include nozzles for use in perforation applications. The area around the nozzles is extremely susceptible to perforation "splash back." In one embodiment, the perforator includes a nozzle assembly 18 for directing (or jetting) an abrasive fluid from inside the perforator tool 10 to outside the perforator tool 10 toward the casing and/or formation. The nozzle assembly 18 can be constructed of various elements known in the art for constructing nozzle assemblies 18, such as shoulder elements 20, sealing rings 22, nozzles 24, threaded portions, etc. FIGS. 3-5 show various embodiments of how the erosion resistant material 12 can be disposed on the perforator tool 10 relative to the nozzle assembly 18. It should be understood and appreciated that the nozzle assembly 18 can include only a nozzle 24.

The embodiment disclosed in FIG. 3 shows the erosion resistant material 12 disposed on the outer surface 14 of the perforator tool 10 under a portion of the nozzle assembly 18. In a further embodiment, the erosion resistant material 12 is disposed on the outer surface 14 of the perforator tool 10 under the shoulder element 20 of the nozzle assembly 18. It should be understood and appreciated that the erosion resistant material 12 can be metalurgically bonded to the outer surface 14 of the perforator tool 10 prior to adding any element of the nozzle assembly 18. In another embodiment, the erosion resistant material 12 can be machined or treated to provide an appropriate surface (e.g., flat and/or smooth) for the support of the nozzle assembly 18.

The embodiment disclosed in FIG. 4 shows the erosion resistant material 12 disposed on the outer surface 14 of the perforator tool 10 adjacent to the nozzle assembly 18. In one embodiment, the erosion resistant material 12 is metalurgically bonded to the outer surface 14 of the perforator tool 10 and an area of the erosion resistant material 12 is removed to permit the nozzle assembly 18 to be mounted to the perforator tool 10 and be adjacent to the layer of erosion resistant material 12. In another embodiment, a machinable plug can be placed to reserve the place of the nozzle assembly 18 on the perforator tool 10. The erosion resistant material 12 can then be metalurgically bonded to the outer surface 14 of the perforator tool 10. Once the erosion resistant material 12 is metalurgically bonded to the outer surface 14 of the perforator tool 10, the machinable plug is removed and the nozzle assembly 18 can then be set in the perforator tool 10.

The embodiment disclosed in FIG. 5 shows the erosion resistant material 12 disposed on the outer surface 14 of the perforator tool 10 and a portion of the nozzle assembly 18. In a further embodiment, the erosion resistant material 12 is disposed on the outer surface 14 of the perforator tool 10 and over the shoulder element 20 of the nozzle assembly 18. In one embodiment, the erosion resistant material 12 is applied to the perforator tool 10 after the nozzle assembly 18 is installed in the perforator tool 10. In another embodiment, a machinable plug can be placed to reserve the place of the nozzle assembly 18 on the perforator tool 10. The erosion resistant material 12 can then be metalurgically bonded to the outer surface 14 of the perforator tool 10. Once the erosion resistant material 12 is metalurgically bonded to the outer surface 14 of the perforator tool 10, the machinable plug is removed and the nozzle assembly 18 can then be set in the perforator tool 10. After the nozzle assembly 18 is set in the perforator tool 10, erosion resistant material 12 can be metalurgically bonded over a portion of the nozzle assembly 18.

In another embodiment, the layer of erosion resistant material 12 metalurgically bonded to substantially all of the inner surface 16 of the perforator tool 10 to mitigate internal erosion (or washing) of the perforator tool 10. In a further embodiment, the layer of erosion resistant material 12 can be disposed on the inner surface 16 of the perforator tool 10 at only preselected locations where more erosion is experienced. In yet another embodiment, the preselected locations where the erosion resistant material 12 is disposed on the inner surface 16 of the perforator tool 10 can be areas within a predetermined proximity to the nozzles 24.

In yet another embodiment of the present disclosure, the inner surface 16 of the perforator tool 10 can be provided with the erosion resistant material 12 via a boriding process, which causes boron containing compounds to be diffused into the inner surface 16 of the perforator tool 10. The boriding process permits the boron containing compounds to be diffused into the perforator tool 10 to create an extremely hard layer that can be thousandths of an inch thick. In one embodiment, the boron containing compound can be applied to the inner surface 16 of the perforator tool 10 as a powder or paste. Once the boron containing power or paste is applied to the inner surface 16 at the desired locations, the perforator tool 10 can then be heated for a predetermined amount of time at a predetermined temperature. It should be understood and appreciated that the entire perforator tool 10 can be boronized.

Figure 6:
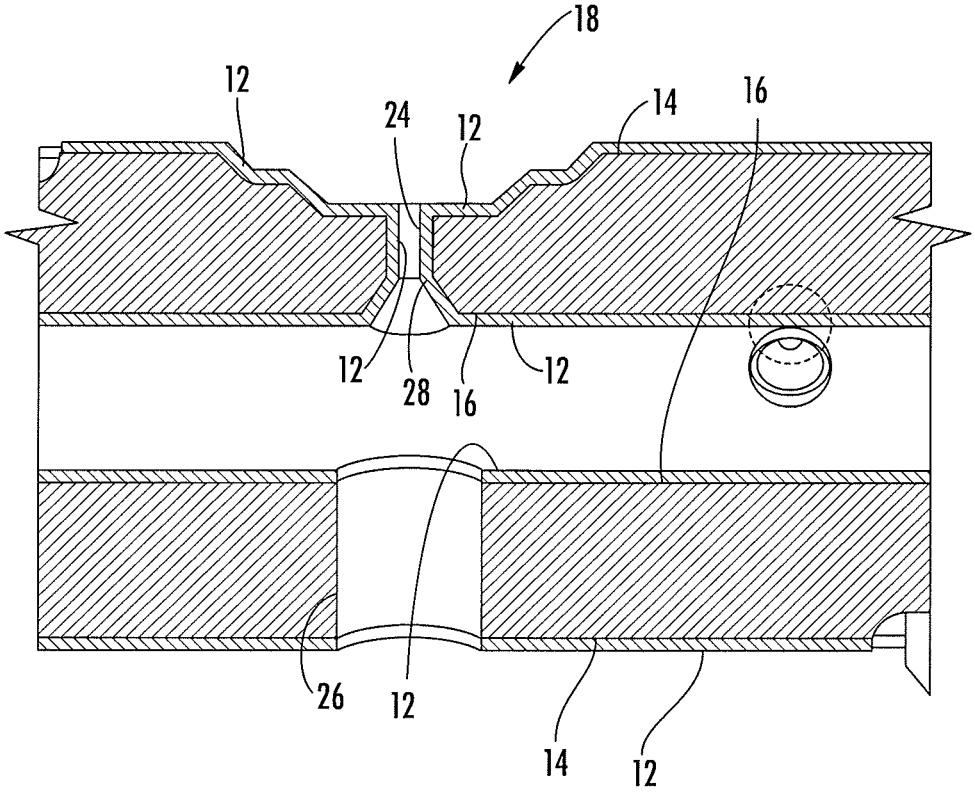
FIG. 6 is a cross-sectional view of another embodiment of a portion of the perforator tool constructed in accordance with the present disclosure.

In another embodiment of the present disclosure shown in FIG. 6, the nozzle 24 (or integral port) can be machined directly into the perforator tool 10. In this embodiment it is not necessary to have a nozzle assembly that is threaded, secured or attached to the perforator tool 10. In this case there would be no additional nozzle components. The nozzle 24 can be machined in the perforator tool by any method known in art. For example, the nozzle 24 can be machined by accessing the nozzle 24 via an access port 26 disposed in the perforator tool 10. The access port 26 can be plugged once machining of at least a portion of the nozzle 24 is completed. In another embodiment, an internal portion 28 of the nozzle 24 can be coated with the erosion resistant material 12. The erosion resistant material 12 can either be metalurgically bonded or coated via the boriding process described herein.

Figure 7A:
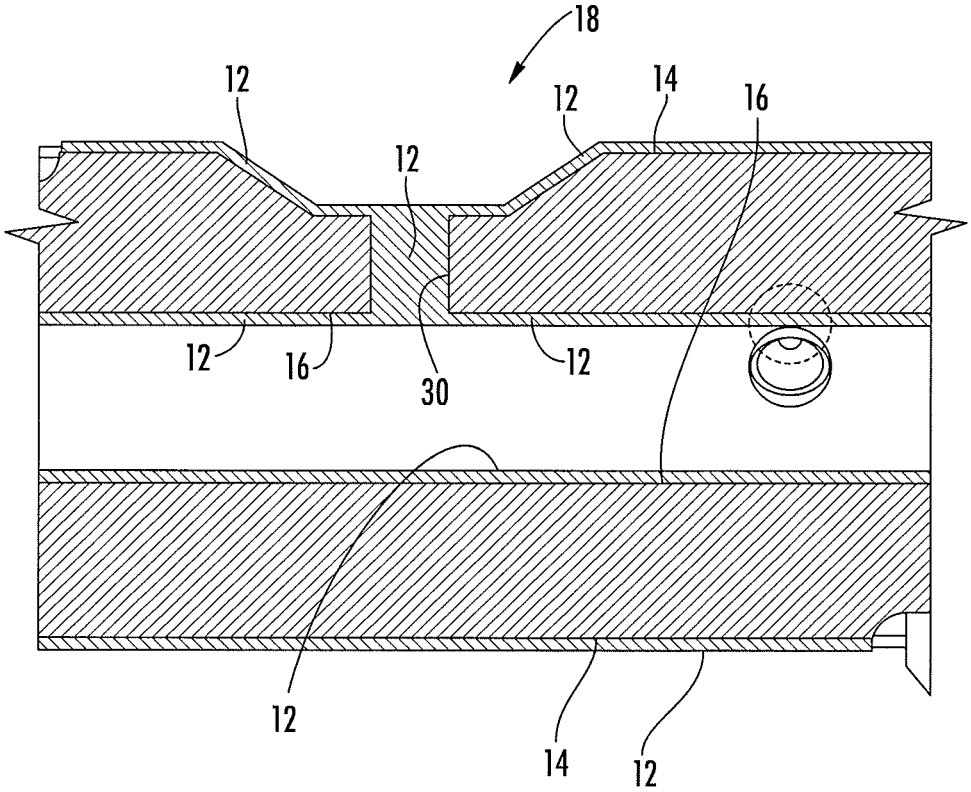
FIGS. 7A and 7B are cross-sectional views of other embodiments of a portion of the perforator tool constructed in accordance with the present disclosure.
Figure 7B:
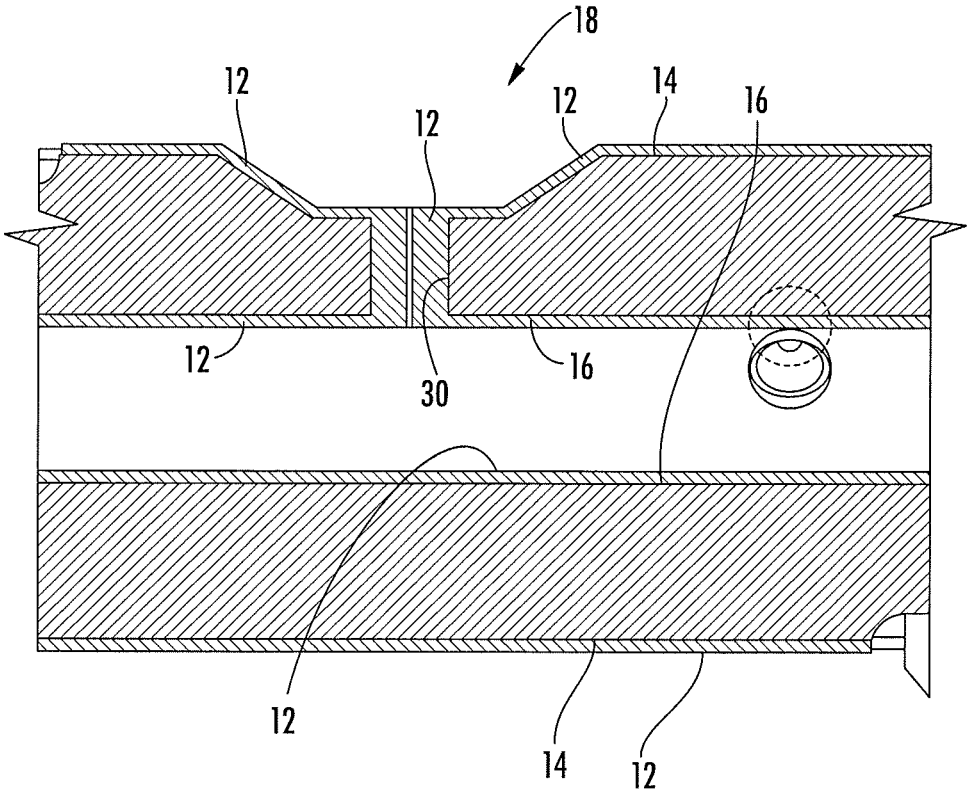
Figure 8:
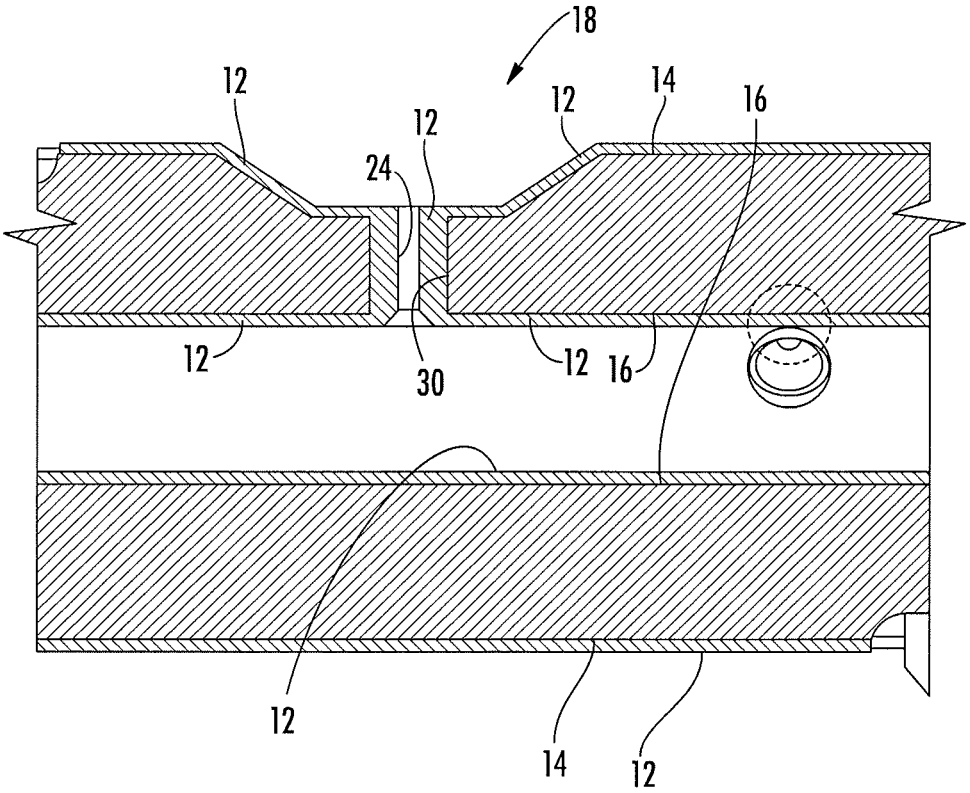
FIG. 8 is a cross-sectional view of yet another embodiment of a portion of the perforator tool constructed in accordance with the present disclosure.

In yet another embodiment of the present disclosure and depicted in FIGS. 7A, 7B, and 8, the perforator tool 10 can have an opening 30 disposed therein. FIGS. 7A and 7B show the opening 30 in the perforator tool 10 filled with a metalurgically bonded material as described herein. FIG. 7A shows the opening 30 completely filled with the metalurgically bonded material and FIG. 7B shows the opening 30 partially filled with the metalurgically bonded material. FIG. 8 shows the metalurgically bonded material in the opening 30 having a nozzle 24 disposed directly into the metalurgically bonded material.

Figure 9:
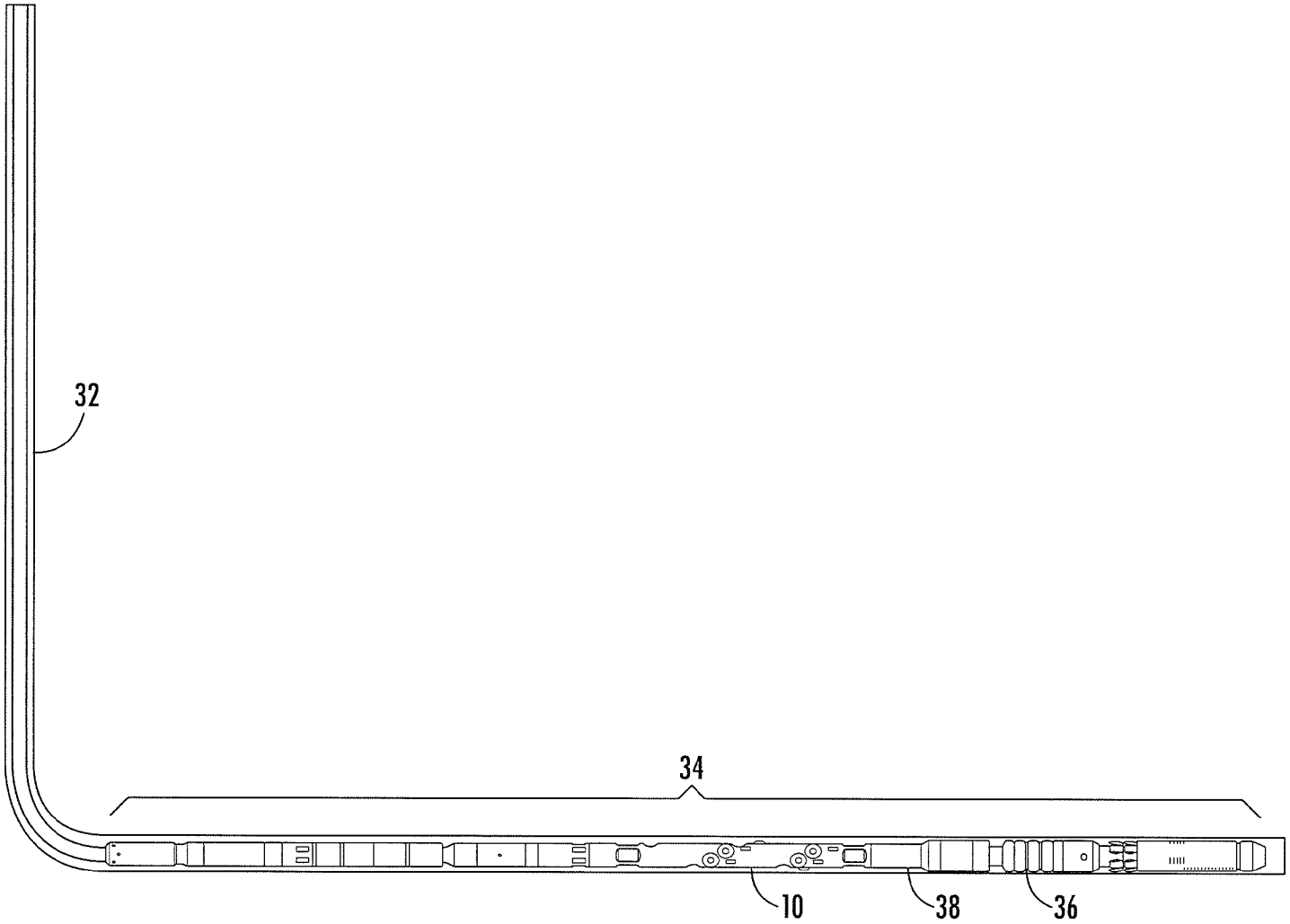
FIG. 9 is a side elevation view of one embodiment of the present disclosure.

The present disclosure is also directed to a method of using the perforator tool 10 as described herein. In one embodiment depicted in FIG. 9, the perforator tool 10 as described herein can be run into a wellbore 32 as part of a bottom hole assembly (BHA) 34. The BHA 34 can include any device known in the art for use in a BHA, such as drilling motor, CT Connector, flapper valve, jar, hydraulic disconnect, LWD, MWD, etc. The perforator tool 10 can be run into cased or uncased wellbores to create perforations at a first location in the casing and/or formation. Once the perforation has been done the formation can be fractured at the perforations created at the first location and to facilitate the removal and collection of hyrdrocarbons from the formation. In a further embodiment, the perforator tool 10 can be moved to a second location in the wellbore to perform further perforating of the casing and/or formation. Another fracturing operation can be done to fracture the formation at the perforations created at the second location and facilitate the removal of hydrocarbons from the second location. It should be understood that multiple locations can be perforated and fractured during one trip of the BHA 34 (and thus, the perforator tool 10) into the well. It should also be understood that multiple locations can be perforated and then a single fracturing operation could be done to fracture perforations in the multiple locations. In a further embodiment, the perforator tool 10 is run into the wellbore with a packer 36. The packer 36 helps facilitate the perforating and fracturing of the multiple locations and/or zones of the formation with one trip of the BHA. In yet another embodiment of the present disclosure, a vibratory tool 38 can be included in the BHA 34 to facilitate the movement and positioning of the perforator tool 10 and the BHA 34 in the wellbore 32. The vibratory tool 38 can be any type of vibration causing device known in the art for use in a wellbore.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A method, the method comprising:

providing an abrasive perforator having at least one nozzle assembly disposed therein into a wellbore, the perforator having an erosion resistant material metallurgically bonded to at least a portion of an outer surface between the outer surface and at least a portion of the at least one nozzle assembly wherein the erosion resistant material shares electrons with the perforator at an interface.

2. The method of claim 1 wherein the erosion resistant material contains tungsten carbide.

3. The method of claim 1 wherein the erosion resistant material includes a matrix material to facilitate the bond of the erosion resistant material onto the perforator, the matrix material is selected from the group consisting of nickel, cobalt, chromium, tungsten, molybdenum, silicon, iron, carbon, boron, aluminum, and a combination thereof.

4. The method of claim 1 wherein the perforator includes at least one nozzle assembly and the erosion resistant material is disposed atop a portion of the at least one nozzle assembly.

5. The method of claim 1 wherein at least a portion of an inner surface of the perforator includes a boron containing compound that is diffused into the inner surface of the perforator.

6. The method of claim 1 wherein the perforator has at least one nozzle disposed therein, the at least one nozzle having the erosion resistant material disposed on an internal portion of the nozzle.

7. The method of claim 1 wherein the perforator has a nozzle machined in erosion resistant material metallurgically bonded to sides of an opening in the perforator.

8. The method of claim 1 further comprising the step of providing a vibratory tool into the wellbore with the perforator.

9. The method of claim 1 further comprising the step of providing a packer into the wellbore with the perforator.

10. The method of claim 9 further comprising the step of setting the packer and perforating at one or more locations in the wellbore and fracturing the one or more locations once the step of perforating all of the one or more locations is completed.

11. The method of claim 9 further comprising perforating at one or more locations in the wellbore, then setting the packer and fracturing the one or more locations once the step of perforating all of the one or more locations is completed.

12. The method of claim 9 further comprising the step of positioning the perforator and the packer at least one location in the wellbore, each positioning step includes setting the packer, perforating and fracturing the formation at the at least one location in the wellbore prior to repositioning the perforator and packer to another location.

13. A method, the method comprising:

providing an abrasive perforator into a wellbore, the perforator having an erosion resistant material diffused into at least a portion of an inner surface of the perforator and an erosion resistant material metallurgically bonded onto an outer surface of the perforator, the perforator includes at least one nozzle assembly wherein the metallurgically bonded erosion resistant material is disposed between a portion of the at least one nozzle assembly and the outer surface of the perforator.

14. The method of claim 13 wherein the perforator that includes at least one nozzle disposed therein, the nozzle having the erosion resistant material disposed on an internal portion of the nozzle, the erosion resistant material being a boron containing compound that is diffused into the inner surface of the downhole tool and the internal portion of the nozzle.

15. The method of claim 13 wherein at least a portion of an outer surface of the perforator is provided with the erosion resistant material diffused thereon.

16. The method of claim 13 further comprising the step of providing a vibratory tool into the wellbore with the perforator.

17. The method of claim 13 further comprising the step of providing a packer into the wellbore with the perforator.

18. The method of claim 17 further comprising the step of setting the packer and perforating at one or more locations in the wellbore and fracturing the one or more locations once the step of perforating all of the one or more locations is completed.

19. The method of claim 17 further comprising perforating at one or more locations in the wellbore, then setting the packer and fracturing the one or more locations once the step of perforating all of the one or more locations is completed.

20. The method of claim 17 further comprising the step of positioning the perforator and the packer at least one location in the wellbore, each positioning step includes setting the packer, perforating and fracturing the formation at the at least one location in the wellbore prior to repositioning the perforator and packer to another location.

21. The method of claim 13 wherein the downhole tool includes an access port disposed in a sidewall of the downhole tool for receiving the nozzle assembly, the access port free from erosion resistant material.

* * * * *